US012631401B2

(12) United States Patent
Chen et al.

(10) Patent No.: US 12,631,401 B2
(45) Date of Patent: May 19, 2026

(54) VAPOR CHAMBER, HOUSING ASSEMBLY AND ELECTRONIC DEVICE

(71) Applicant: Beijing Xiaomi Mobile Software Co., Ltd., Beijing (CN)

(72) Inventors: Anqi Chen, Beijing (CN); Duzi Huang, Beijing (CN); Mingyan Liu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 178 days.

(21) Appl. No.: 17/975,099

(22) Filed: Oct. 27, 2022

(65) Prior Publication Data

US 2024/0060726 A1 Feb. 22, 2024

(30) Foreign Application Priority Data

Aug. 18, 2022 (CN) ..... 202210995378.4

(51) Int. Cl.
*F28D 15/04* (2006.01)
*F28D 21/00* (2006.01)

(52) U.S. Cl.
CPC .... *F28D 15/046* (2013.01); *F28D 2021/0029* (2013.01)

(58) Field of Classification Search
CPC ..... F28D 15/04; F28D 15/043; F28D 15/046; F28D 2021/0029
See application file for complete search history.

(56) References Cited

U.S. PATENT DOCUMENTS 4,021,816 A 5/1977 Peck
8,243,449 B2 * 8/2012 Oniki ..... F28D 15/046 174/15.2
11,058,031 B2 * 7/2021 Numoto ..... F28D 15/04
11,231,235 B2 * 1/2022 Wakaoka ..... F28D 15/0233
2007/0056711 A1 * 3/2007 Ohsawa ..... B23P 15/26 165/104.21
2007/0163755 A1 * 7/2007 Kim ..... H01L 23/427 165/104.21
2007/0240858 A1 * 10/2007 Hou ..... F28D 15/046 165/146
2010/0157535 A1 * 6/2010 Oniki ..... H05K 7/20336 165/104.19
2017/0160017 A1 6/2017 Macdonald
(Continued)

FOREIGN PATENT DOCUMENTS

CN 110514045 A 11/2019
CN 110715570 A 1/2020
(Continued)

OTHER PUBLICATIONS

Extended European Search Report dated Aug. 16, 2023 for European Patent Application No. 22204443.0.

*Primary Examiner* — Travis Ruby
(74) *Attorney, Agent, or Firm* — Volpe Koenig

(57) ABSTRACT

A vapor chamber includes: a body, including an accommodating cavity; a wick structure layer, located in the accommodating cavity; and a wick structure channel, located in the accommodating cavity. The wick structure channel is at least partially located outside the wick structure layer; or, the wick structure channel is located in the wick structure layer, and fluid resistance of the wick structure channel is smaller than fluid resistance of the wick structure layer.

17 Claims, 10 Drawing Sheets

(56) References Cited

U.S. PATENT DOCUMENTS

| | | | | |
|---|---|---|---|---|
| 2017/0350657 | A1* | 12/2017 | Yeh | F28D 15/046 |
| 2018/0156545 | A1* | 6/2018 | Delano | F28D 15/043 |
| 2018/0164043 | A1* | 6/2018 | Kurashima | F28D 15/02 |
| 2019/0141855 | A1 | 5/2019 | Inagaki et al. | |
| 2019/0353429 | A1 | 11/2019 | Zhang | |
| 2020/0003499 | A1* | 1/2020 | Kume | F28D 15/046 |
| 2020/0080791 | A1 | 3/2020 | Yokoyama et al. | |
| 2020/0221605 | A1 | 7/2020 | Vanderwees | |
| 2020/0221606 | A1* | 7/2020 | Lee | F28D 15/0233 |
| 2020/0323103 | A1* | 10/2020 | Lee | F28D 15/046 |
| 2021/0392781 | A1* | 12/2021 | Oda | F28D 15/046 |
| 2022/0279678 | A1* | 9/2022 | Takahashi | F28D 15/043 |

FOREIGN PATENT DOCUMENTS

| | | | |
|---|---|---|---|
| CN | 113532171 | A | 10/2021 |
| CN | 113543574 | A | 10/2021 |
| CN | 214502178 | U | 10/2021 |
| CN | 114251964 | A | 3/2022 |
| CN | 216852857 | A | 6/2022 |
| CN | 216852857 | U | 6/2022 |
| DE | 202015100111 | U1 | 2/2015 |
| WO | 2021213391 | A1 | 10/2021 |

* cited by examiner

VAPOR CHAMBER, HOUSING ASSEMBLY AND ELECTRONIC DEVICE

CROSS REFERENCE TO RELATED APPLICATION

The present application claims priority to the Chinese Patent Application No. 202210995378.4, filed on Aug. 18, 2022. The entire contents of the above-listed application are hereby incorporated by reference for all purposes.

BACKGROUND

In the field of electronic heat dissipation, especially portable electronic devices such as mobile phones and tablets are gradually becoming thinner and lighter, and the problem about effective heat dissipation under a limited size is becoming more and more serious. Ultra-thin vapor chambers, as phase change heat transfer components, are widely used for heat dissipation of portable electronic devices due to excellent heat transfer performance and temperature uniformity.

SUMMARY

The disclosure relates to the technical field of electronic devices, in particular to a vapor chamber, a housing assembly and an electronic device.

According to a first aspect of the disclosure, a vapor chamber is provided and includes: a body including an accommodating cavity; a wick structure layer located in the accommodating cavity; and a wick structure channel located in the accommodating cavity. The wick structure channel is at least partially located outside the wick structure layer, or, the wick structure channel is located in the wick structure layer, and fluid resistance of the wick structure channel is smaller than fluid resistance of the wick structure layer.

According to a second aspect of the disclosure, a housing assembly is provided and includes a housing body and a vapor chamber. The housing body includes a mounting groove, and the vapor chamber is at least partially located in the mounting groove. The vapor chamber includes: a body including an accommodating cavity; a wick structure layer located in the accommodating cavity; and a wick structure channel located in the accommodating cavity. The wick structure channel is at least partially located outside the wick structure layer, or, the wick structure channel is located in the wick structure layer, and fluid resistance of the wick structure channel is smaller than fluid resistance of the wick structure layer.

According to a third aspect of the disclosure, an electronic device is provided and includes a housing assembly. The housing assembly includes a housing body and a vapor chamber. The housing body includes a mounting groove, and the vapor chamber is at least partially located in the mounting groove. The vapor chamber includes: a body including an accommodating cavity; a wick structure layer located in the accommodating cavity; and a wick structure channel located in the accommodating cavity. The wick structure channel is at least partially located outside the wick structure layer, or, the wick structure channel is located in the wick structure layer, and fluid resistance of the wick structure channel is smaller than fluid resistance of the wick structure layer.

BRIEF DESCRIPTION OF THE DRAWINGS

The accompanying drawings, which are intended to provide a further understanding of the disclosure and constitute a part of the description, serve to explain the disclosure together with the following specific embodiments, but do not constitute a limitation on the disclosure. In the accompanying drawings.

DETAILED DESCRIPTION

Figure 1:
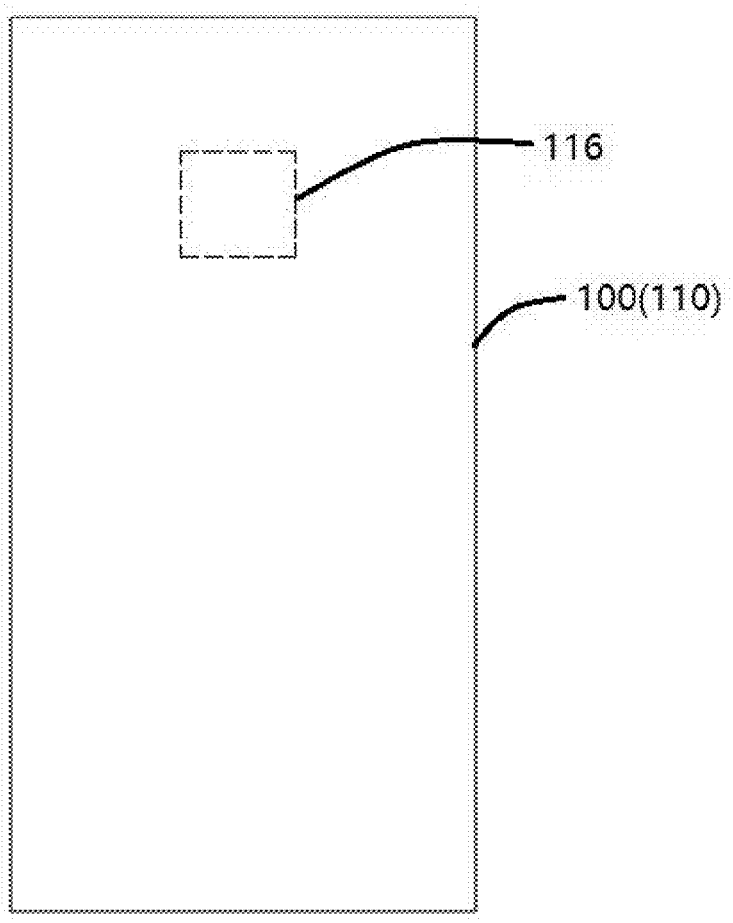
FIG. 1 is a front view of a vapor chamber provided in example 1 of the disclosure.

The specific implementation of the disclosure will be described in detail below in combination with the accompanying drawings. It should be understood that the specific implementation described here is merely used to illustrate and explain the disclosure and are not used to limit the disclosure.

In the disclosure, where not stated to the contrary, directional terms "inside", "outside", etc. refer to the inside and outside to the outline of a component or structure. In addition, it is to be noted that terms "first", "second", etc. are used to distinguish one element from another, and are not of order or importance. In addition, in the description with reference to the accompanying drawings, the same reference numeral in different accompanying drawings represents the same element.

A vapor chamber is a vacuum cavity with a wick structure on an inner wall. When heat is conducted from a heat source to an evaporation region, a liquid medium in the cavity begins to vaporize after being heated in a low vacuum environment, and absorbs heat energy and expands rapidly in volume to form a gaseous medium which quickly fills the entire cavity, and condensation occurs when the gaseous medium reaches a cool region. Through the condensation phenomenon, heat accumulated during evaporation is released, and the condensed liquid medium may return to the evaporation heat source through the wick structure. The operation may be repeated in the cavity.

The inventor found that with as portable electronic devices become thinner and lighter, vapor chambers are getting thinner and thinner, the thickness of ultra-thin vapor chambers commonly used in mobile phones at present has reached 0.3 mm, and carryover effects of the vapor chambers are enhanced due to the extreme lightness and thinness, which leads to obstruction on gas-liquid circulation. In addition, the vapor chambers are limited by the layout of internal components of the electronic devices, and due to a special-shaped structure of the vapor chambers configured according to the layout of the components, steam in some special-shaped regions is difficult to diffuse, and return water is limited. Thus, the temperature uniformity performance of a current ultra-thin vapor chamber has gradually been difficult to meet heat dissipation requirements of the portable electronic devices.

The purpose of the disclosure is to provide a vapor chamber, a housing assembly and an electronic device. The vapor chamber is conducive to enhancing a backflow effect of a liquid medium, and has desirable heat dissipation performance.

According to a first aspect of the disclosure, a vapor chamber is provided. As shown in FIG. 1 to FIG. 9, the vapor chamber includes a body 110, a wick structure layer 120 and a wick structure channel 130. The body 110 has an accommodating cavity 111, and the wick structure layer 120 and the wick structure channel 130 is disposed in the accommodating cavity 111. The wick structure channel 130 is at least partially located outside the wick structure layer 120. Alternatively, the wick structure channel 130 is located in the wick structure layer 120, and fluid resistance of the wick structure channel 130 is smaller than fluid resistance of the wick structure layer 120.

Through the above technical solution, the wick structure layer 120 may be used to guide circulation of a condensed liquid medium, that is, backflow of the liquid medium. When the wick structure channel 130 is disposed in the accommodating cavity 111, and the wick structure channel 130 is at least partially located outside the wick structure layer 120, backflow of the liquid medium can be increased through the wick structure channel 130 to form an additional backflow path, as shown by a backflow path a in FIG. 3, which facilitates gas-liquid circulation of the medium and improves heat dissipation efficiency. When the wick structure channel 130 is located in the wick structure layer 120, and the fluid resistance of the wick structure channel 130 is smaller than the fluid resistance of the wick structure layer 120, a speed of backflow of the liquid medium can be increased to accelerate the gas-liquid circulation and improve the heat dissipation efficiency. In this way, the vapor chamber provided by the disclosure is conducive to enhancing the backflow effect of the liquid medium, and has a better heat dissipation performance.

The body 110 may be made of a metal material, such as copper, stainless steel, titanium alloy and aluminum, which is not specifically limited in the disclosure.

The body 110 may directly or indirectly make contact with a heat source element and perform heat conduction, so as to absorb and dissipate heat generated by the heat source element.

The body 110 may be applied to an electronic device or other apparatus that require heat dissipation. Taking application to the electronic device such as a mobile phone or a tablet computer as an example, the body 110 may be mounted on a middle frame 210 or a back cover, and the heat source element includes but is not limited to a mainboard, a processor, and various components that generate heat of the electronic device. The body 110 may be directly attached to the heat source element for heat conduction, or may indirectly make contact with the heat source element through the middle frame 210 or the like for heat conduction, which is not specifically limited by the disclosure.

As shown in FIG. 1, the body 110 may have a heat source region 116 for heat conduction with the heat source element, and the heat source element transfers heat to the body 110 through the heat source region 116. The wick structure layer 120 may have an evaporation region 121 opposite to the heat source region 116 in position. In the evaporation region 121, the liquid medium is heated and evaporated to generate a gaseous medium, and the gaseous medium diffuses to a low temperature region outside the evaporation region 121, so as to form a liquid medium after condensation in the low temperature region, and return to the evaporation region 121 through the wick structure layer 120 and the wick structure channel 130, such that the gas-liquid circulation is formed to continuously dissipate heat of the heat source element.

Figure 2:
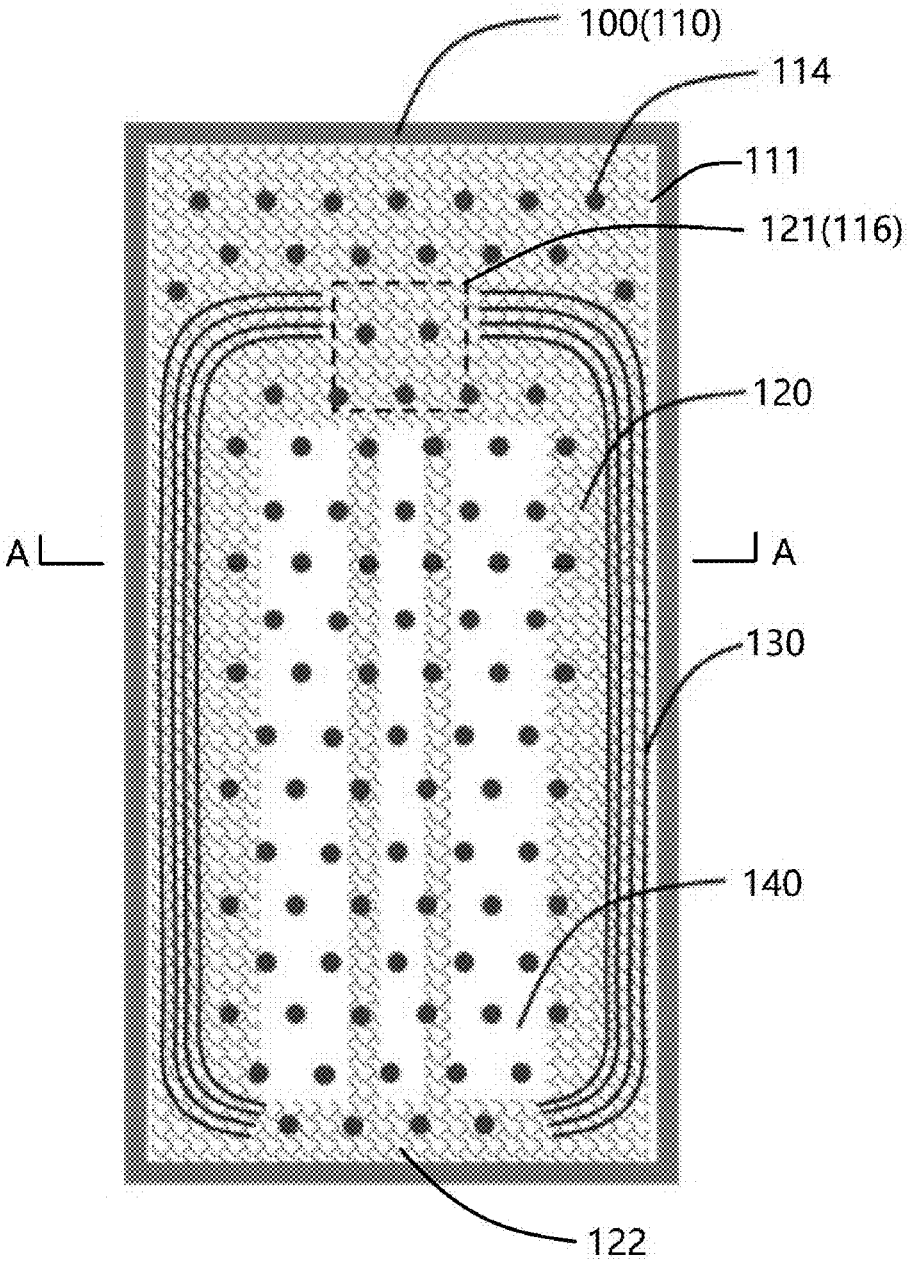
FIG. 2 is a schematic structural diagram of a vapor chamber provided in example 1 of the disclosure, where a first sub-body part of a body is removed.
Figure 3:
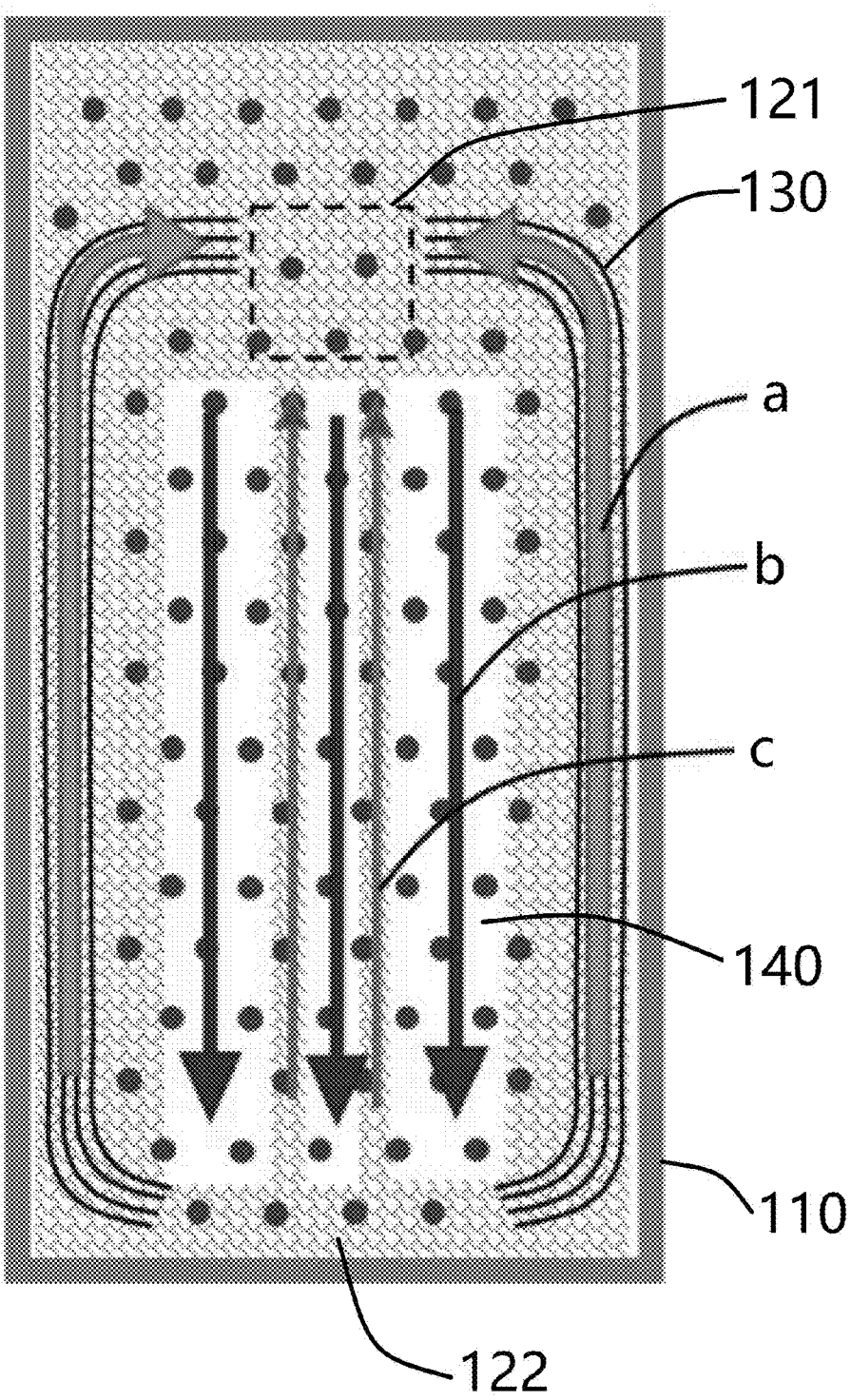
FIG. 3 is a schematic structural diagram of a vapor chamber provided in example 1 of the disclosure, where a first sub-body part of a body is removed, and illustrates backflow paths of a liquid medium and a diffusion path of a gaseous medium.

In some embodiments, as shown in FIG. 2 and FIG. 3, the wick structure channel 130 may extend from the evaporation region 121 in a direction away from the evaporation region 121, such that the condensed liquid medium in the low temperature region outside the evaporation region 121 may be collected to the evaporation region 121 through the wick structure channel 130. In this way, the wick structure channel 130 forms an additional backflow path other than the wick structure layer 120 to increase the flow or speed of backflow of the liquid medium, such that the heat dissipation effect can be enhanced, and the heat dissipation efficiency can be improved.

In some embodiments, as shown in FIG. 2 and FIG. 3, the wick structure layer 120 has a condensation region 122, the wick structure channel 130 extend from the evaporation region 121 to the condensation region 122, a first fluid space 140 extending from the evaporation region 121 to the condensation region 122 is disposed in the wick structure layer 120, and the first fluid space 140 is at least used for circulation of the gaseous medium. In this way, the gaseous medium produced by evaporation in the evaporation region 121 can quickly reach the condensation region 122 through the first fluid space 140, for example, through a diffusion path b illustrated in FIG. 3, and the liquid medium formed after condensation in the condensation region 122 can quickly flow back to the evaporation region through the co-action of the wick structure layer 120 and the wick structure channel 130, for example, a backflow path through the wick structure channel 130 may refer to a backflow path a in FIG. 3. In this way, gas-liquid circulation can be accelerated, and thus the heat dissipation efficiency can be improved.

The condensation region 122 may be any region in the low temperature region other than the evaporation region 121. FIG. 3 merely illustrates one possible position of the condensation region 122. It can be understood that there may be a plurality of the condensation regions 122, that is, the first fluid space 140 and the wick structure channel 130 may be disposed between the evaporation region 121 and each of the plurality of the condensation regions 122 to accelerate gas-liquid circulation.

In some embodiments, two opposite sides of the first fluid space 140 may be provided with the wick structure channels 130. For example, as shown in FIG. 3, after the gaseous medium reaches the condensation region 122 for condensation via the diffusion path b, the liquid medium formed after condensation in the condensation region 122 may flow back to the evaporation region 121 through the wick structure channels 130 on the two opposite sides of the first fluid space 140 to increase the flow of backflow.

There may be a plurality of the first fluid spaces 140 disposed at intervals, such that resistance to the gaseous medium can be further reduced, the diffusion speed and flow of the gaseous medium can be increased, and thus gas-liquid circulation can be accelerated.

The plurality of the first fluid spaces 140 are disposed at intervals, and a backflow path may also be formed between two adjacent first fluid spaces 140, for example, as shown by a backflow path c in FIG. 3, such that the liquid medium can also flow back via the backflow path c, the flow path of the liquid medium is distributed, and backflow of the liquid medium is accelerated.

Respective widths of the plurality of the first fluid spaces 140 may be the same or different, and may be set according to actual application requirements, which is not specifically limited in the disclosure.

The plurality of the first fluid spaces 140 may be located between the two wick structure channels 130. Or, the plurality of the first fluid spaces 140 and a plurality of the wick structure channels 130 may be disposed alternately in sequence, so as to uniformly distribute the flow path of the gaseous medium and the flow path of the liquid medium to achieve the effect of diversion.

In some embodiments, the wick structure layer 120 has grooves and/or through holes 123 penetrating through the wick structure layer 120, and the first fluid spaces 140 include the grooves and/or the through holes 123. FIG. 4 to FIG. 6 and FIG. 9 illustrate an implementation in which the wick structure layer 120 has the through holes 123. In other embodiments, the grooves may also be provided in the wick structure layer 120. Alternatively, both the grooves and the through holes 123 may be provided in the wick structure layer 120, which is not specifically limited in the disclosure.

Figure 4:
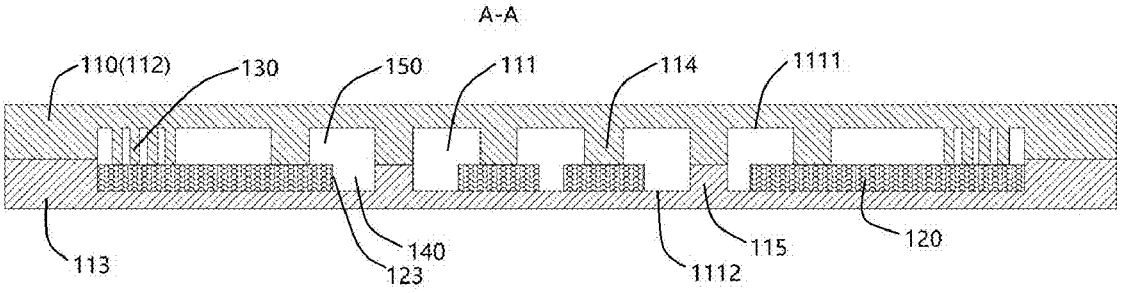
FIG. 4 is a schematic cross-sectional view of a position A-A in FIG. 2.
Figure 5:
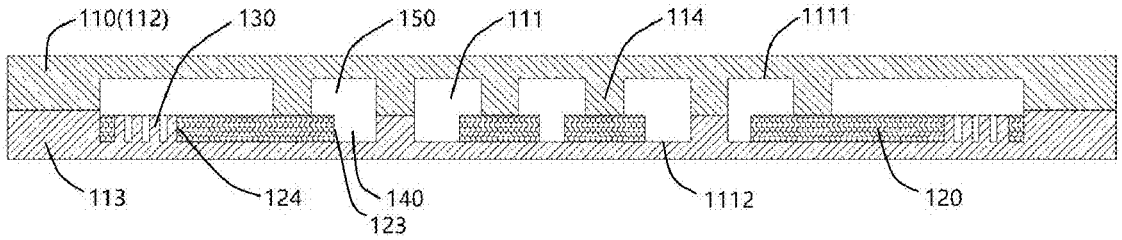
FIG. 5 is a cross-sectional view of a vapor chamber provided in example 2 of the disclosure.

In some embodiments, as shown in FIG. 4 and FIG. 5, the accommodating cavity 111 has a first inner wall surface 1111 and a second inner wall surface 1112 opposite to each other, a second fluid space 150 at least used for circulation of the gaseous medium is disposed between the wick structure layer 120 and the first inner wall surface 1111, and a side, facing away from the second fluid space 150, of the wick structure layer 120 is attached to the second inner wall surface 1112. Through the second fluid space 150, the diffusion speed of the gaseous medium can be increased, such that the gaseous medium can quickly fill the accommodating cavity 111, and the heat dissipation effect can be improved.

The wick structure channel 130 may be matched with the wick structure layer 120 in any suitable manner according to practical application requirements, the purpose of which is to increase the flow or speed of backflow of the liquid medium.

For example, in example 1, the wick structure channel 130 may be disposed on the first inner wall surface 1111, and a side, facing away from the first inner wall surface 1111, of the wick structure channel 130 is attached to the wick structure layer 120 or penetrates through the wick structure layer 120. FIG. 4 illustrates an implementation in which one end of the wick structure channel 130 is connected to the first inner wall surface 1111, and the other end is attached to the wick structure layer 120. In this way, by using the second fluid space 150 and disposing the wick structure channel 130 connected to the first inner wall surface 1111 in the second fluid space 150, the space in the accommodating cavity 111 can be fully utilized, such that the flow or speed of backflow of the liquid medium can be increased, and the heat dissipation effect can be improved. Thus, on this basis, the vapor chamber 100 has a desirable backflow effect, such that the vapor chamber 100 can be made thinner, which is beneficial to the light and thin design of the vapor chamber 100.

In addition, when the vapor chamber is connected to a middle frame of an electronic device such as a mobile phone, in the related art, a large-area vapor chamber is fixed to the middle frame through holes in the middle frame and rim lap, due to the requirements of the strength of the middle frame and the adhesive area of a battery, it is difficult to make the area of the vapor chamber large, which limits the heat dissipation capacity of the mobile phone.

Figure 10:
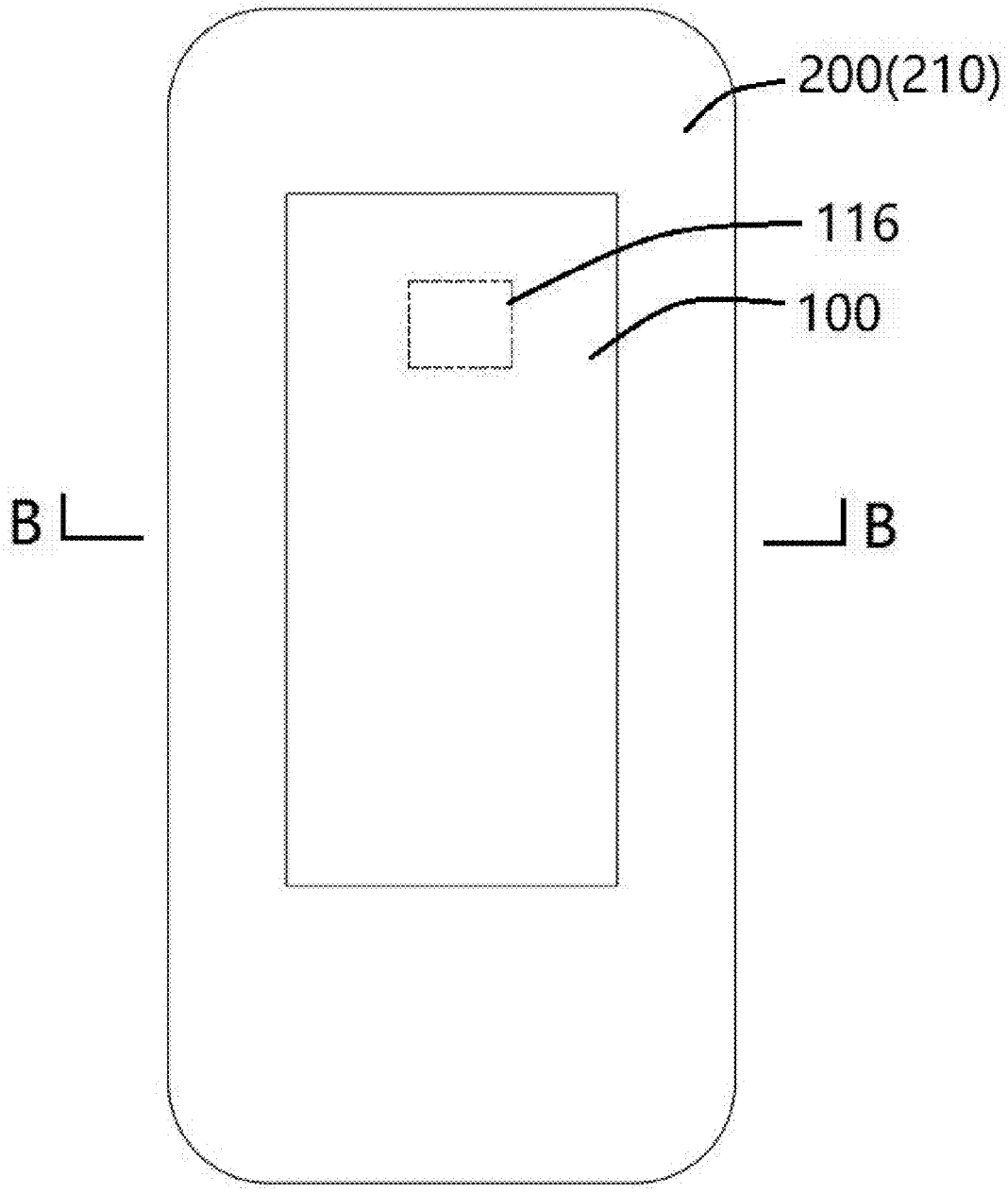
FIG. 10 is a schematic diagram of matching of a vapor chamber and a middle frame provided in an implementation of the disclosure.
Figure 11:
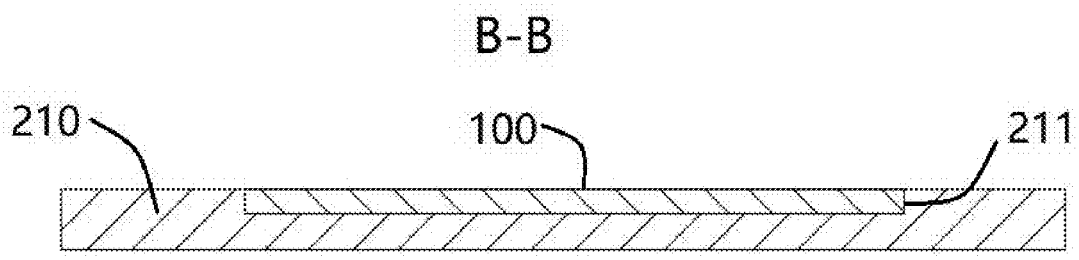
FIG. 11 is a schematic cross-sectional view of a position B-B in FIG. 10.

While the vapor chamber provided by the disclosure makes full use of the space (the second fluid space 150) between the wick structure layer 120 and the accommodating cavity 111, such that the backflow effect of the vapor chamber 100 can be better, and the vapor chamber 100 can be made thinner. In this way, as shown in FIG. 10 and FIG. 11, a mounting groove 211 may be provided in the middle frame 210, and the vapor chamber 100 is accommodated in the mounting groove 211 to avoid being affected by the strength of the middle frame and the adhesive area of the battery as in the prior art, the area of the vapor chamber 100 can be further enlarged, and the heat dissipation capability of the electronic device can be improved.

In example 1, as shown in FIG. 2 and FIG. 4, the wick structure channel 130 may be constructed as a grooved wick structure, and the grooved wick structure may generate a siphon effect through grooves of the grooved wick structure so as to generate a wick force for transferring the liquid medium from one end to the other end, such that a backflow effect of the liquid medium is achieved, and the wick structure channel 130 may cooperate with the wick structure layer 120 to make the liquid medium quickly flow back to the evaporation region 121.

In example 1, the wick structure channel 130 may also be constructed the same as the wick structure of the wick structure layer 120. The wick structure layer 120 may adopt, for example, a copper mesh wick structure or a copper powder wick structure, so as to increase the flow of backflow of the liquid medium through superposition of the wick structure channels 130 and the wick structure layer 120.

In example 2, as shown in FIG. 5, the wick structure channel 130 may be constructed as a grooved wick structure disposed on the second inner wall surface 1112, and the wick structure layer 120 has an accommodating region 124 for accommodating the grooved wick structure. Due to the siphon effect of the grooved wick structure, fluid resistance of the grooved wick structure to the liquid medium is smaller than fluid resistance of the structure layer 120 adopting, for example, a copper mesh wick structure or a copper powder wick structure, such that the speed of backflow of the liquid medium can be increased when the liquid medium flows along the wick structure channel 130.

Figure 6:
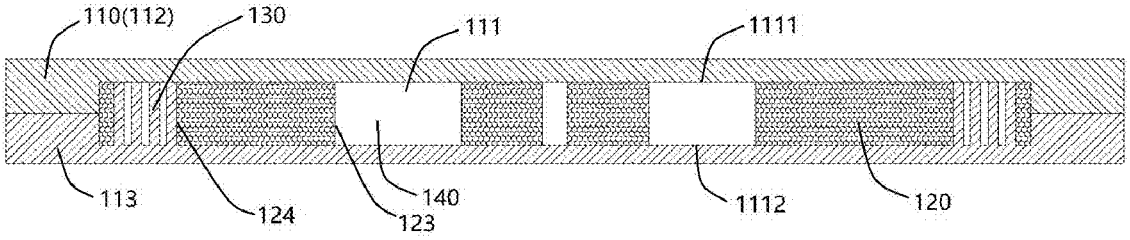
FIG. 6 is a cross-sectional view of a vapor chamber provided in example 3 of the disclosure.

In example 3, as shown in FIG. 6, the accommodating cavity 111 has a first inner wall surface 1111 and a second inner wall surface 1112 opposite to each other, two opposite sides of the wick structure layer 120 are attached to the first inner wall surface 1111 and the second inner wall surface 1112 respectively, the wick structure channel 130 is constructed as a grooved wick structure disposed in the first inner wall surface 1111 or the second inner wall surface 1112, and the wick structure layer 120 has an accommodating region 124 for accommodating the grooved wick structure. In this way, as the two opposite sides of the wick structure layer 120 are attached to the first inner wall surface 1111 and the second inner wall surface 1112 respectively, the thickness of the body 110 of the vapor chamber 100 can be further reduced, which is conducive to the light and thin design. In addition, in this manner, the gaseous medium may be diffused through the first fluid space 140, and the liquid medium may flow back through the wick structure layer 120 and the wick structure channel 130.

Based on the above examples, as shown in FIG. 4 to FIG. 8, the body 110 may include a first sub-body part 112 and a second sub-body part 113 connected to each other, the accommodating cavity 111 is defined between the first sub-body part 112 and the second sub-body part 113, the first inner wall surface 1111 is formed on the first sub-body part 112, and the second inner wall surface 1112 is formed on the second sub-body part 113.

The first sub-body part 112 may be made of, for example, a copper plate, a first accommodating groove may be provided in the copper plate, a bottom surface of the first accommodating groove is the first inner wall surface 1111, and when the wick structure channel 130 is constructed as the grooved wick structure and is disposed in the first inner wall surface 1111, the wick structure channel 130 may be formed on the copper plate by etching.

Figure 7:
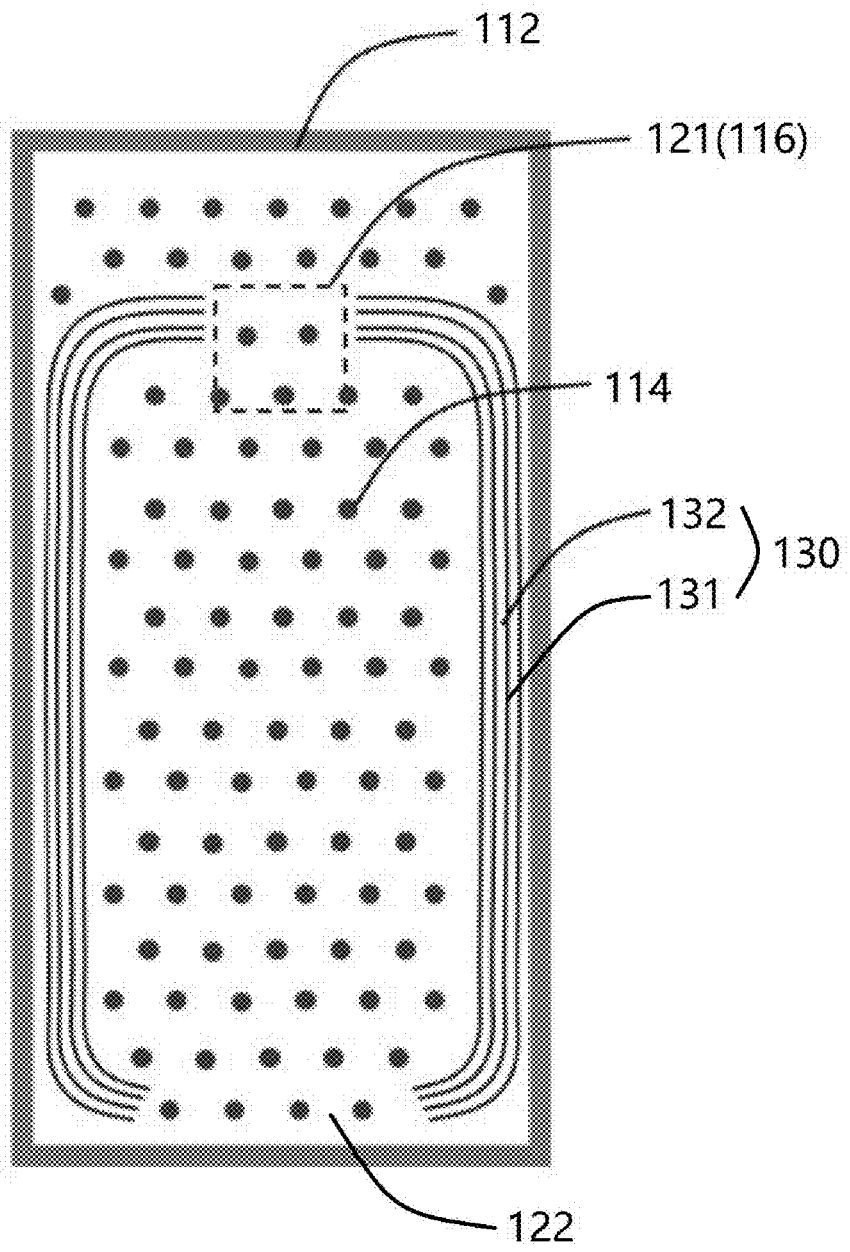
FIG. 7 is a schematic structural diagram of a first sub-body part of a vapor chamber provided in example 1 of the disclosure.
Figure 8:
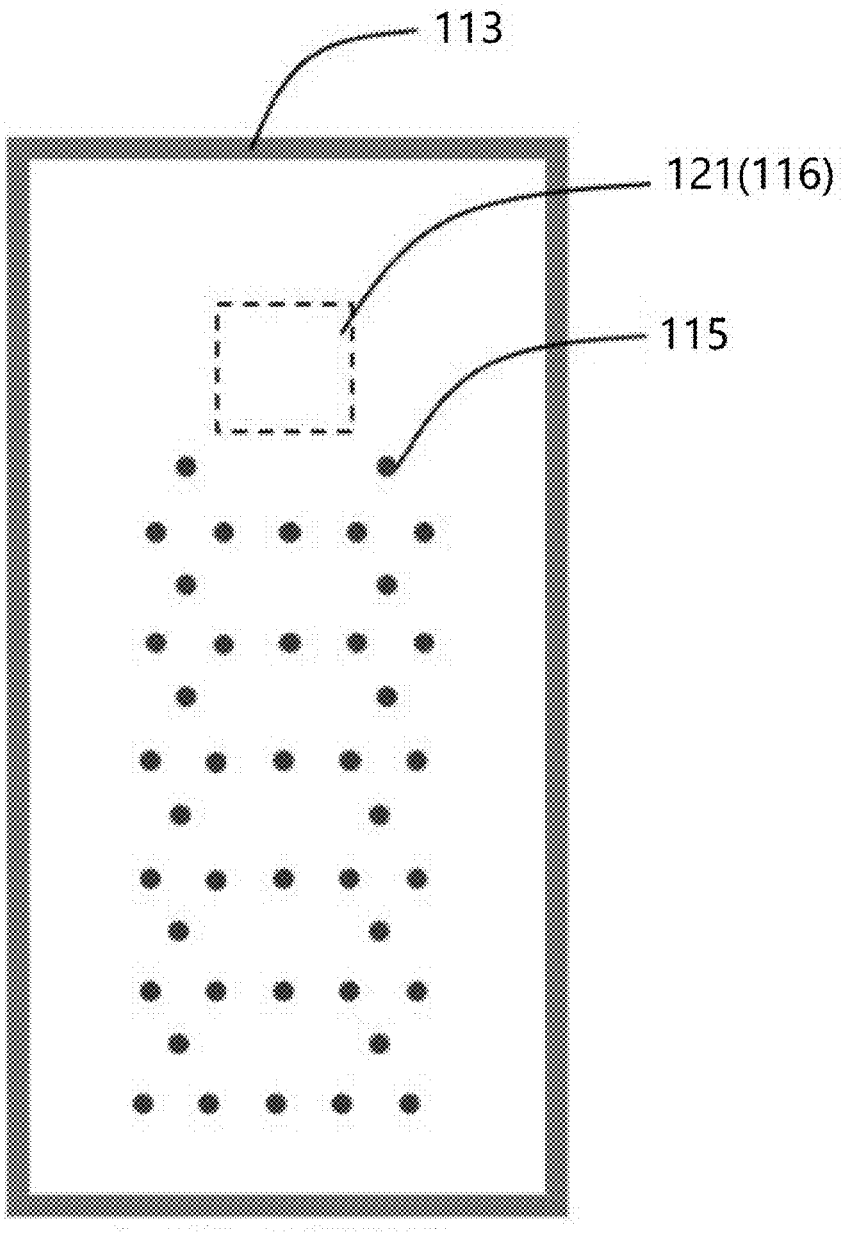
FIG. 8 is a schematic structural diagram of a second sub-body part of a vapor chamber provided in example 1 of the disclosure.
Figure 9:
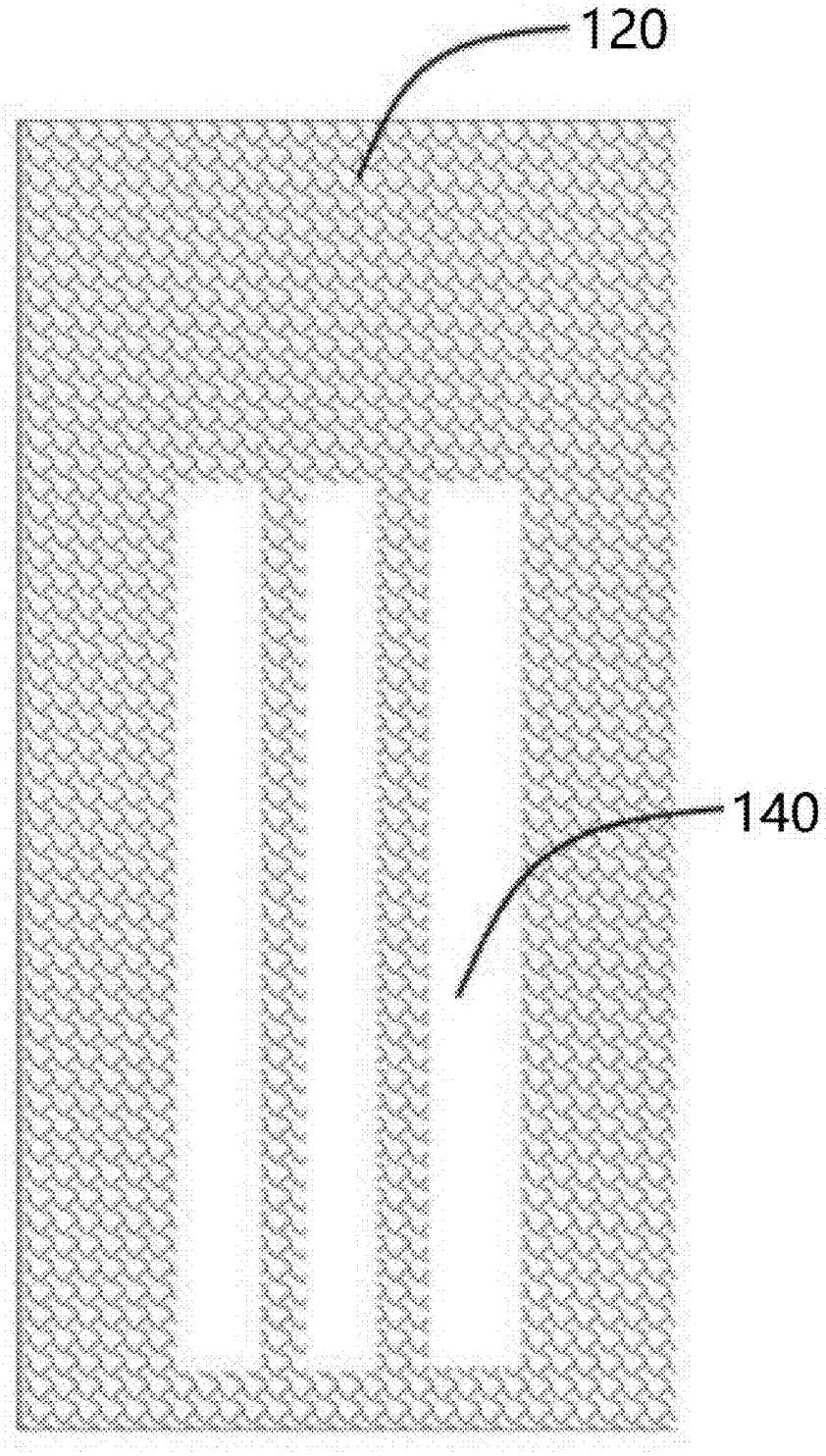
FIG. 9 is a schematic structural diagram of a wick structure layer of a vapor chamber provided in example 1 of the disclosure.

As shown in FIG. 7, the grooved wick structure may include a plurality of protrusions 131 disposed side by side and extending in a same direction, and the grooves 132 located between every two adjacent protrusions 131. Return of the liquid medium may be achieved through the wick force generated by the siphon effect of the grooves 132.

In addition, a width of the grooves 132 may be 0.1 mm-0.2 mm, and/or a depth of the grooves 132 may be 0.05 mm-0.15 mm, so as to achieve a better siphon effect.

The second sub-body part 113 may be made of, for example, a copper plate, and a second accommodating groove may be provided in a side, facing the first sub-body part 112, of the second sub-body part 113. A bottom surface of the second accommodating groove is the second inner wall surface 1112, and the wick structure layer 120 may be disposed on the second inner wall surface 1112. For example, when the wick structure layer 120 adopts the copper mesh wick structure or the copper powder wick structure, the wick structure layer 120 may be formed by placing copper powder or a copper mesh on the copper plate for sintering. When the wick structure layer 120 adopts the copper mesh wick structure, the first fluid space 140 may be achieved by etching, die cutting, or laser cutting. When the wick structure layer 120 adopts the copper powder wick structure, the first fluid space 140 may be fabricated by selective printing.

As shown in FIG. 2, FIG. 4, FIG. 5 and FIG. 8, a first support part 114 is disposed on the first inner wall surface 1111, and the first support part 114 abuts against the wick structure layer 120; or, the first support part 114 abuts against the second inner wall surface 1112; or, the first support part 114 abuts against a second support part 115 disposed on the second inner wall surface 1112. In this way, the structural strength of the body 110 can be enhanced by the first support part 114 and/or the second support part 115, so that the vapor chamber 100 is not prone to deformation. The first support part 114 and the second support part 115 may be formed on the sub-body parts respectively by etching or machining, which is not specifically limited in the disclosure.

The first sub-body part 112 and the second sub-body part 113 may be welded together by brazing, diffusion welding, or resistance welding, etc., and the vapor chamber is formed by the manufacturing process of liquid injection, degassing and rattail cutting for the vapor chamber known to those skilled in the art. The working medium injected into the vapor chamber 100 may be, for example, pure water or a refrigerant, which is not specifically limited in the disclosure.

Figure 12:
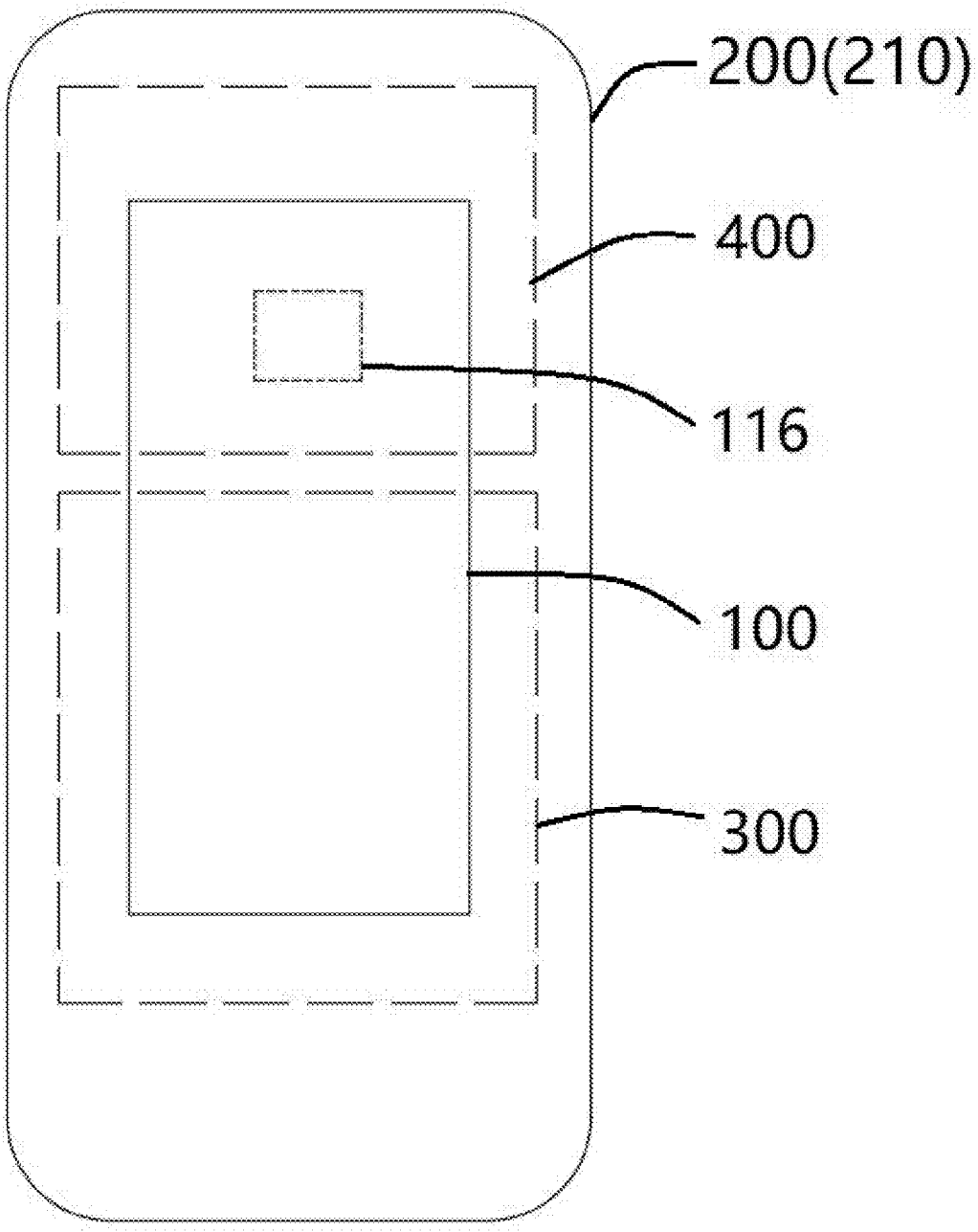
FIG. 12 is a schematic structural diagram of a housing assembly provided in an implementation of the disclosure.

Based on the vapor chamber provided in the first aspect of the disclosure, a second aspect of the disclosure provides a housing assembly. As shown in FIG. 10 to FIG. 12, the housing assembly includes a housing body 200 and the above vapor chamber 100. The housing body 200 is provided with a mounting groove 211, and the vapor chamber 100 is at least partially accommodated in the mounting groove 211. The housing assembly may be used in electronic devices such as cell phones, tablet computers and notebook computers. In addition, the vapor chamber 100 provided by the disclosure has the benefits of a desirable backflow effect and high heat dissipation performance, and in addition, the vapor chamber 100 can be made thinner, which is beneficial to the thin and light design of the vapor chamber 100. In this way, by providing the mounting groove 211 in a middle frame 210 and accommodating the vapor chamber 100 in the mounting groove 211, the influence of strength of the middle frame and an adhesive area of the battery as in the related art can be avoided, the area of the vapor chamber 100 can be further enlarged, and the heat dissipation performance of the electronic device can be improved.

Based on the above embodiments, a total thickness of a first sub-body part 112 may be 0.1 mm-0.2 mm, a total thickness of a second sub-body part 113 may be 0.1 mm-0.2 mm, and a thickness of a wick structure layer may be 0.02 mm-0.1 mm. A large-area vapor chamber with a thickness of a body 110 being 0.18 mm-0.3 mm, and an effective area being greater than 2000 $mm^2$-7000 $mm^2$ may be achieved. When the thickness of the body 110 is 0.25-0.3 mm, the heat transfer performance of the vapor chamber is improved by 100% or more compared with that of an ultra-thin vapor chamber in the related art. When the thickness of the body 110 is 0.18 mm-0.25 mm, the heat transfer performance of the vapor chamber is improved by 200% or more compared with that of the ultra-thin vapor chamber in the related art.

In some embodiments, as shown in FIG. 10 to FIG. 12, the housing body 200 includes the middle frame 210, a first side of the middle frame 210 is used for disposing the battery 300 and/or a heat source element, and the mounting groove 211 is disposed in a second side, opposite to the first side, of the middle frame 210. In this way, the vapor chamber 100 is disposed on a side, facing away from the battery 300 and the heat source element, of the middle frame 210, and is not limited by the adhesive area of the battery 300 and arrangement of the heat source element, and the area of the vapor chamber 100 can be further enlarged to facilitate heat dissipation of the electronic device. In some embodiments, the wick structure layer 120 may be attached to the second inner wall surface 1112 of the second sub-body part 113 of the vapor chamber 100. When the vapor chamber 100 is mounted, the second sub-body part 113 of the vapor chamber 100 may be attached to a bottom surface of the mounting groove 211, and the first sub-body part 112 may be located on a side, facing away from the middle frame 210, of the vapor chamber 100. In this way, as the second sub-body part 113 is attached to the bottom surface of the mounting groove 211, it is convenient for the liquid medium in the evaporation region 121 of the wick structure layer 120 to be heated and evaporated during heat exchange with the heat source element through the middle frame 210, the heat conduction effect is enhanced, and the heat dissipation efficiency is improved.

The heat source element may be, for example, a mainboard, a processor, and various related components disposed in a mainboard region 400, which is not specifically limited in the disclosure.

In some embodiments, the housing body 200 may include a back cover (not shown in the figure), and the mounting groove 211 is provided in an inner wall surface of the back cover. The back cover may be a battery back cover of devices such as mobile phones and tablet computers. In this way, the vapor chamber 100 can absorb the heat of the heat source element and dissipate the heat through the back cover, so as to improve the heat dissipation effect of the electronic device.

In some embodiments, the housing body 200 may further include a back housing (not shown in the figure). The back housing is located between the back cover and the middle frame 210, and may be connected to the middle frame 210 such that a circuit board and the like may be sandwiched between the back housing and the middle frame 210. In this way, the vapor chamber 100 may also be connected to a side, facing away from the middle frame 210, of the back housing to dissipate heat from components on the circuit board.

According to a third aspect of the disclosure, an electronic device is provided and includes the above housing assembly. The electronic device may be, for example, a mobile phone, a tablet computer, a notebook computer, and a wearable device, and has all the beneficial effects of the above vapor chamber and housing assembly, which will not be repeated in the disclosure.

The preferred embodiments of the disclosure are described in detail above in combination with the accompanying drawings. However, the disclosure is not limited to the specific details of the above embodiments. Within the scope of the technical concept of the disclosure, a variety of simple modifications can be made to the technical solutions of the disclosure, and these simple modifications belong to the protection scope of the disclosure.

In addition, it needs to be noted that the specific technical features described in the above specific embodiments may be combined in any suitable way without contradiction. In order to avoid unnecessary repetition, various possible combinations will not be described in the disclosure.

In addition, different embodiments of the disclosure can also be combined arbitrarily, and as long as the embodiments do not violate the spirit of the disclosure, the embodiments shall also be regarded as the contents disclosed in the disclosure.

Additional non-limiting embodiments of the disclosure include:

1. A vapor chamber, including: a body including an accommodating cavity; a wick structure layer located in the accommodating cavity; and a wick structure channel located in the accommodating cavity; where the wick structure channel is at least partially located outside the wick structure layer; or, the wick structure channel is located in the wick structure layer, and fluid resistance of the wick structure channel is smaller than fluid resistance of the wick structure layer.

2. The vapor chamber of embodiment 1, where the wick structure layer has an evaporation region, and the wick structure channel extends from the evaporation region in a direction away from the evaporation region.

3. The vapor chamber of embodiment 2, where the wick structure layer has a condensation region, the wick structure channel extends from the evaporation region to the condensation region, a first fluid space extending from the evaporation region to the condensation region is located in the wick structure layer, and the first fluid space is at least used for circulation of a gaseous medium.

4. The vapor chamber of embodiment 2, where a plurality of the first fluid spaces is arranged at intervals; where the plurality of the first fluid spaces are located between two of the wick structure channels; or, a plurality of wick structure channels and the plurality of the first fluid spaces are arranged alternately in sequence.

5. The vapor chamber of embodiments 3 or 4, where the wick structure layer has grooves and/or through holes penetrating through the wick structure layer, and the first fluid space includes the grooves and/or the through holes.

6. The vapor chamber of any one of embodiments 1 to 5, where the accommodating cavity has a first inner wall surface and a second inner wall surface opposite to each other, a second fluid space at least used for circulation of a gaseous medium is located between the wick structure layer and the first inner wall surface, and a side, facing away from the second fluid space, of the wick structure layer is attached to the second inner wall surface.

7. The vapor chamber of embodiment 6, where the wick structure channels is located on the first inner wall surface, and a side, facing away from the first inner wall surface, of the wick structure channel is attached to the wick structure layer or penetrates through the wick structure layer.

8. The vapor chamber of embodiment 7, where the wick structure channel is constructed as a grooved wick structure; or, the wick structure channel is constructed the same as a wick structure of the wick structure layer.

9. The vapor chamber of embodiment 6, where the wick structure channel is constructed as a grooved wick structure located in the second inner wall surface, and the wick structure layer has an accommodating region for accommodating the grooved wick structure.

10. The vapor chamber of any one of embodiments 1 to 5, where the accommodating cavity has a first inner wall surface and a second inner wall surface opposite to each other, two opposite sides of the wick structure layer are attached to the first inner wall surface and the second inner wall surface respectively, the wick structure channel is constructed as a grooved wick structure located in the first inner wall surface or the second inner wall surface, and the wick structure layer has an accommodating region for accommodating the grooved wick structure.

11. The vapor chamber of any one of embodiments 6 to 10, where the body includes a first sub-body part and a second sub-body part connected to each other, the accommodating cavity is defined between the first sub-body part and the second sub-body part, the first inner wall surface is located on the first sub-body part, and the second inner wall surface is located on the second sub-body part.

12. The vapor chamber of embodiment 11, where a first support part is located on the first inner wall surface, and the first support part abuts against the wick structure layer; or, the first support part abuts against the second inner wall surface; or, the first support part abuts against a second support part located on the second inner wall surface.

13. The vapor chamber of any one of embodiments 1-12, where the wick structure channel is constructed as a grooved wick structure.

14. The vapor chamber of embodiment 13, where the grooved wick structure include a plurality of protrusions arranged side by side and extending in a same direction, and grooves located between every two adjacent protrusions.

15. The vapor chamber of embodiment 14, where a width of the grooves is 0.1 mm-0.2 mm, and/or a depth of the grooves is 0.05 mm-0.15 mm.

16. A housing assembly, including a housing body and the vapor chamber of any one of embodiments 1-15, where the housing body includes a mounting groove, and the vapor chamber is at least partially located in the mounting groove.

17. the housing assembly of embodiment 16, where the housing body includes a middle frame, a first side of the middle frame is used for disposing a battery and/or a heat source element, and the mounting groove is located in a second side, opposite to the first side, of the middle frame.

18. the housing assembly of embodiment 16, where the housing body includes a rear cover, and the mounting groove is disposed in an inner wall surface of the rear cover.

19. An electronic device, including the housing assembly of any one of embodiments 16 to 18.

What is claimed is:

1. A vapor chamber, comprising:

a body comprising an accommodating cavity;

a wick structure layer located in the accommodating cavity; and a wick structure channel located in the accommodating cavity;

wherein the wick structure channel is located in the wick structure layer, and fluid resistance of the wick structure channel is smaller than fluid resistance of the wick structure layer, and the wick structure layer has an accommodating region for accommodating the wick structure channel;

wherein the accommodating cavity has a second inner wall surface, the wick structure layer is attached to the second inner wall surface, the wick structure channel is constructed as a grooved wick structure located in the second inner wall surface, and the accommodating region is defined by a groove recessed within the wick structure layer, wherein the groove runs through the wick structure layer along a thickness direction of the wick structure layer, the wick structure channel is inserted into the groove, and a thickness of the wick structure channel is equal to a thickness of the wick structure layer.

2. The vapor chamber according to claim 1, wherein the wick structure layer comprises an evaporation region, and the wick structure channel extends from the evaporation region in a direction away from the evaporation region.

3. The vapor chamber according to claim 2, wherein the wick structure layer comprises a condensation region, the wick structure channel extends from the evaporation region to the condensation region, a first fluid space extending from the evaporation region to the condensation region is located in the wick structure layer, and the first fluid space is at least used for circulation of a gaseous medium.

4. The vapor chamber according to claim 3, wherein a plurality of the first fluid spaces is arranged at intervals;

wherein the plurality of the first fluid spaces are located between two of the wick structure channels.

5. The vapor chamber according to claim 1, wherein the accommodating cavity has a first inner wall surface and the second inner wall surface opposite to each other, a second fluid space at least used for circulation of a gaseous medium is located between the wick structure layer and the first inner wall surface, and a side, facing away from the second fluid space, of the wick structure layer is attached to the second inner wall surface.

6. The vapor chamber according to claim 5, wherein the wick structure channel is located on the first inner wall surface, and a side, facing away from the first inner wall surface, of the wick structure channel is attached to the wick structure layer or penetrates through the wick structure layer.

7. The vapor chamber according to claim 6, wherein the wick structure channel is constructed the same as a wick structure of the wick structure layer.

8. The vapor chamber according to claim 1, wherein the accommodating cavity has a first inner wall surface and the second inner wall surface opposite to each other, two opposite sides of the wick structure layer are attached to the first inner wall surface and the second inner wall surface respectively.

9. A housing assembly, comprising:

a vapor chamber, comprising:

a body comprising an accommodating cavity;

a wick structure layer located in the accommodating cavity;

a wick structure channel located in the accommodating cavity;

wherein the wick structure channel is located in the wick structure layer, and fluid resistance of the wick structure channel is smaller than fluid resistance of the wick structure layer, and the wick structure layer has an accommodating region for accommodating the wick structure channel, the accommodating cavity has a second inner wall surface, the wick structure layer is attached to the second inner wall surface, the wick structure channel is constructed as a grooved wick structure located in the second inner wall surface, and the accommodating region is defined by a groove recessed within the wick structure layer, the wick structure channel is inserted into the groove; and a housing body comprising a mounting groove, wherein the vapor chamber is at least partially located in the mounting groove.

10. The housing assembly according to claim 9, wherein the wick structure layer comprises an evaporation region, and the wick structure channel extends from the evaporation region in a direction away from the evaporation region.

11. The housing assembly according to claim 10, wherein the wick structure layer comprises a condensation region, the wick structure channel extends from the evaporation region to the condensation region, a first fluid space extending from the evaporation region to the condensation region is located in the wick structure layer, and the first fluid space is at least used for circulation of a gaseous medium.

12. The housing assembly according to claim 9, wherein the accommodating cavity has a first inner wall surface and the second inner wall surface opposite to each other, a second fluid space at least used for circulation of a gaseous medium is located between the wick structure layer and the first inner wall surface, and a side, facing away from the second fluid space, of the wick structure layer is attached to the second inner wall surface.

13. The housing assembly according to claim 12, wherein the wick structure channel is located on the first inner wall surface, and a side, facing away from the first inner wall surface, of the wick structure channel is attached to the wick structure layer or penetrates through the wick structure layer; or, the wick structure channel is constructed the same as a wick structure of the wick structure layer.

14. The housing assembly according to claim 9, wherein the accommodating cavity has a first inner wall surface and the second inner wall surface opposite to each other, two opposite sides of the wick structure layer are attached to the first inner wall surface and the second inner wall surface respectively.

15. The housing assembly according to claim 9, wherein the housing body comprises a middle frame, a first side of the middle frame is used for disposing a heat source element, and the mounting groove is located in a second side, opposite to the first side, of the middle frame.

16. The housing assembly according to claim 9, wherein the housing body comprises a rear cover, and the mounting groove is disposed in an inner wall surface of the rear cover.

17. An electronic device, comprising a housing assembly, wherein the housing assembly comprises:

a vapor chamber, comprising:

a body comprising an accommodating cavity;

a wick structure layer located in the accommodating cavity;

a wick structure channel located in the accommodating cavity;

wherein the wick structure channel is located in the wick structure layer, and fluid resistance of the wick structure channel is smaller than fluid resistance of the wick structure layer, and the wick structure layer has an accommodating region for accommodating the wick structure channel, the accommodating cavity has a second inner wall surface, the wick structure layer is attached to the second inner wall surface, the wick structure channel is constructed as a grooved wick structure located in the second inner wall surface, and the accommodating region is defined by a groove recessed within the wick structure layer, the wick structure channel is inserted into the groove; and a housing body comprising a mounting groove, wherein the vapor chamber is at least partially located in the mounting groove.

* * * * *